US007762659B2

(12) United States Patent
Nishizaka

(10) Patent No.: US 7,762,659 B2
(45) Date of Patent: Jul. 27, 2010

(54) RECORDING APPARATUS, COMPUTER READABLE MEDIUM STORING THEREON RECORDING CONTROL PROGRAM AND RECORDING METHOD

(75) Inventor: Katsuhiko Nishizaka, Kitakyusyu (JP)

(73) Assignee: Seiko Epson Corporation, Tokyo (JP)

( * ) Notice: Subject to any disclaimer, the term of this patent is extended or adjusted under 35 U.S.C. 154(b) by 843 days.

(21) Appl. No.: 11/654,851

(22) Filed: Jan. 17, 2007

(65) Prior Publication Data

US 2007/0165059 A1 Jul. 19, 2007

(30) Foreign Application Priority Data

Jan. 17, 2006 (JP) ..... 2006-008708
Jan. 11, 2007 (JP) ..... 2007-003288

(51) Int. Cl.
*B41J 2/01* (2006.01)

(52) U.S. Cl. ..... 347/104; 347/16

(58) Field of Classification Search ..... 347/16, 347/104

See application file for complete search history.

(56) References Cited

U.S. PATENT DOCUMENTS 7,086,729 B2 * 8/2006 Yoshikaie ..... 347/104
7,537,331 B2 * 5/2009 Akase et al. ..... 347/104
7,537,334 B2 * 5/2009 Yang et al. ..... 347/107
7,600,472 B2 * 10/2009 Igarashi et al. ..... 101/366

FOREIGN PATENT DOCUMENTS

JP 2004-330583 11/2004
JP 2005-66960 3/2005

* cited by examiner

*Primary Examiner*—Charlie Peng
(74) *Attorney, Agent, or Firm*—Nutter McClennen & Fish LLP; John J. Penny, Jr.; Michael P. Visconti, III

(57) ABSTRACT

A recording apparatus comprising a carriage having a recording head including a nozzle array with a plurality of nozzles being capable of reciprocably moving over a recording medium to a main-scanning direction, a recording medium conveying unit that conveys the recording medium to a sub-scanning direction intersecting the main-scanning direction, a first detecting unit disposed upstream than the recording head in the sub-scanning direction, a second detecting unit that detects at least the rear edge of the recording medium downstream than the first detecting unit in the sub-scanning direction, and a recording control unit that causes the plurality of nozzles of the recording head to eject ink onto the recording medium based on recording data as the carriage is reciprocated to the main-scanning direction and that causes the recording medium conveying unit to convey the recording medium by a predetermined amount of conveyance.

10 Claims, 7 Drawing Sheets

RECORDING APPARATUS, COMPUTER READABLE MEDIUM STORING THEREON RECORDING CONTROL PROGRAM AND RECORDING METHOD

BACKGROUND

1. Field of the Invention

The present invention relates to a recording apparatus including a carriage having a recording head thereon and reciprocably moving over a recording medium in the main-scanning direction and a recording medium conveying unit being capable of conveying the recording medium in the sub-scanning direction, a recording control computer readable medium storing thereon program for the recording apparatus, and a recording method.

Cross Reference to Related Application: The present application claims priority from Japanese Patent Applications No. 2006-008708 filed on Jan. 17, 2006 and No. 2007-003288filed on Jan. 11, 2007, the contents of which are incorporated herein by reference.

2. Related Art

A recording apparatus including a carriage having a recording head thereon and reciprocably moving over a recording medium in the main-scanning direction and a recording medium conveying unit being capable of conveying the recording medium in the sub-scanning direction has been known as for example, in Japanese Patent Application Publication No. 2005-74968. The carriage of the recording apparatus includes thereon a sensor that detects the end of a recording medium out of contact therewith, which is called as a PW sensor, a PW detector and a paper width sensor (hereinafter referred to as "PW sensor"). In the recording apparatus, the PW sensor scans a recording medium to detect the position of the end of the recording medium in the main-scanning direction when the carriage reciprocates to the main-scanning direction. The recording apparatus specifies the witch of the recording medium in the main-scanning direction based on the end position in the main-scanning direction and determines the width in the main-scanning direction, i.e. the width of the region in, which dots are formed in the main-scanning direction, of a region in which liquid is ejected onto the recording medium based on the specified width of the recording medium in the main-scanning direction.

Additionally, in order to control to record on the recording medium, it is necessary to also specify the start position and the end position of a region in which dots are formed in the sub-scanning direction in addition to the width of the region in which dots are formed in the main-scanning direction. Therefore, the recording apparatus having the PW sensor could utilize the PW sensor in order to detect the front edge position and the rear edge position of the recording medium in being recorded (the front edge position and the rear edge position in the sub-scanning direction). For example, when the recording medium is conveyed to the recording start position at the time at which a recording is started, the front edge of the recording medium is detected by the PW sensor, so that the front edge of the recording medium in a conveying path can be detected and conveyed to the start position of the dot forming region.

Meanwhile, if the recording medium is scanned for each main-scanning in recording and it is detected whether there is any recording medium, it can be specified that the rear edge of the recording medium in being recorded passes from the PW sensor to the downstream side in the sub-scanning direction.

That is to say, the position of the recording medium in the conveying path, which is detected by the PW sensor in main-scanning is determined as the rear edge position of the recording medium in the conveying path, and the rear edge position is determined as the end position of the dot forming region, so that a control to mask dot formation in the region behind the end position (the upstream side of the sub-scanning direction) can be performed.

However, in order to perform the control to mask the dot formation in the region behind the recording medium after the rear edge of the recording medium in being recorded is detected by the PW sensor as described above, the rear edge of the recording medium should be disposed upstream than the recording head for forming dots in the sub-scanning direction Otherwise, the dots could be formed in a region behind the rear edge of the recording medium before the rear edge of the recording medium is detected by the PW sensor. Therefore, there has been a restriction on the carriage that the PW sensor has to be disposed on the upstream side in the sub-scanning direction at more than certain distance from the recording head for forming dots.

Additionally, the position of the rear edge of the recording medium in being recorded, which is specified as described above is varied within the amount of conveyance in main-scanning, so that any error up to the amount of conveyance could be generated. Therefore, there has been a problem that a control to mask the dot formation in the region behind the position of the rear edge of the recording medium in being recorded can not be accurately performed.

Still more, it can be considered that a sensor that detects the rear edge of the recording medium is newly provided on a region upstream than the recording head in the sub-scanning direction instead of the PW sensor, and a mask control is started after it is detected that the rear edge is conveyed by the sensor and then the recording medium is conveyed by a certain distance. However, in this case, there has been a problem for unit for conveying the recording medium that it becomes different between the predetermined certain distance and an actual distance from the position of the rear edge to the recording head detected by the sensor along with the change over time.

Thus, the advantage of the present invention is to provide a recording apparatus being capable of accurately specifying the rear edge of a recording medium in being recorded to accurately perform a control to mask dot formation in the region behind the rear edge of the recording medium in being recorded.

SUMMARY

To achieve the above-described advantage, a first aspect of the present invention provides a recording apparatus. The recording apparatus includes: a carriage having a recording head including a nozzle array with a plurality of nozzles thereon and being capable of reciprocably moving over a recording medium to a man-scanning direction; a recording medium conveying unit that conveys the recording medium to a sub-scanning direction intersecting the main-scanning direction, a first detecting unit disposed upstream than the recording head in the sub-scanning direction that detects at least a rear edge of the recording medium of sub-scanning direction; a second detecting unit placed on the carriage that detects at least the rear edge of the recording medium downstream than the first detecting unit in the sub-scanning direction; and a recording control unit that causes the nozzles of the recording head to eject ink onto a recording surface on the recording medium based on recording data as the carriage is reciprocated to the main-scanning direction and that causes the recording medium conveying unit to convey the recording medium to the sub-scanning direction by a predetermined amount of conveyance. The recording control unit stores as a first correction value a distance between a detecting point of the second detecting unit and the uppermost nozzle among the plurality of nozzles of the nozzle array of the recording head in the sub-scanning direction before performing the recording. The recording control unit, before performing the recording, causes the recording medium conveying unit to convey the recording medium, calculates a distance between the detecting point of the first detecting unit and the detecting point of the second detecting unit based on the amount of conveyance of the recording medium for a period between a time point at which the first detecting unit detects the rear edge and a time point at which the second detecting unit detects the rear edge and stores the same as a second correction value. The recording control unit starts a control to mask dot formation by the recording head at a time when the recording medium is conveyed by the amount of conveyance corresponding to a distance obtained by adding the second correction value to the first correction value after the rear edge of the recording medium in being recorded is detected by the first detecting unit.

To achieve the above-described advantage, a second aspect of the present invention provides a recording apparatus. The recording apparatus includes: a carriage having a recording head thereon and being capable of reciprocably moving over a recording medium to a main-scanning direction; a recording medium conveying unit being capable of conveying the recording medium to a sub-scanning direction; a first detecting unit disposed upstream than the recording medium conveying unit in the sub-scanning direction and being capable of detecting the front edge and the rear edge of the recording medium in the sub-scanning direction, which is conveyed to the sub-scanning direction by the recording medium conveying unit; a second detecting unit placed on the carriage and being capable of detecting the end of the recording medium out of contact therewith downstream than the first detecting unit; and a recording control unit that performs a control to form dots by the recording head on a recording surface of the recording medium based on recording data as the carriage is reciprocated to the main-scanning direction and a control to convey the recording medium by the recording medium conveying unit to the sub-scanning direction by a predetermined mount of conveyance so that a recording on the recording surface of the recording medium is achieved. The recording control unit previously stores as a first correction value a distance between a detecting point of the second detecting unit, which is physically measured in a manufacturing process of the recording apparatus and the uppermost nozzle of the nozzle array of the recording head in the sub-scanning direction. The recording control unit logically measures a distance in the sub-scanning between the detecting point of the first detecting unit and the detecting point of the second detecting unit based on the amount of conveyance for a period between a time point at which the first detecting unit detects the rear edge and a time point at which the second detecting unit detects the rear edge and stores the same as a second correction value. The recording control unit starts a control to mask dot formation by the recording head at a time when the recording medium is conveyed by the amount of conveyance corresponding to a distance obtained by adding the second correction value to the first correction value after the rear edge of the recording medium in being recorded is detected by the first detecting unit.

The correction value is a distance in the sub-scanning direction between a detecting point of the second detecting unit which is placed on the carriage and the uppermost nozzle of the nozzle array of the recording head in the sub-scanning direction. Since the first correction value is physically measured for each recording apparatus in the manufacturing process of the recording apparatus, it will be the correction value unique to each recording apparatus. Therefore, even if mounting locations of the recording head and the second detecting unit on the carriage is varied within a manufacturing error in the manufacturing process of the recording apparatus, the distance in the sub-scanning direction between the uppermost nozzle of the nozzle array of the recording head in the sub-scanning direction and the detecting point of the second detecting unit can be accurately specified.

Here, "the distance between a detecting point of the second detecting unit and the uppermost nozzle of the nozzle array of the recording head in the sub-scanning direction" being the first correction according to the present embodiment is a distance of the recording medium in the sub-scanning direction, i.e. a conveying direction. Therefore, if the detecting point of the second detecting unit is at a position in the sub-scanning direction upstream than the uppermost nozzle of the nozzle array of the recording head in the sub-scanning direction, the distance is in a positive direction (positive number value). Alternatively, if the detecting point of the second detecting unit is at a position in the sub-scanning direction downstream than the uppermost nozzle of the nozzle array of the recording head in the sub-scanning direction, the distance is in a negative direction (negative number value).

The second correction value is a distance in the sub-scanning direction between a detecting point of the first detecting unit and a detecting point of the second detecting unit. The second correction value can be logically specified based on the amount of conveyance of the recording medium for a period between at a time at which the recording medium is conveyed in the sub-scanning direction and the rear edge is detected by the first detecting unit and a time at which the second detecting unit detects the rear edge. Therefore, even if mounting locations of the first detecting unit and a conveying accuracy of the recording medium conveying unit is varied within a manufacturing error in the manufacturing process of the recording apparatus, the distance in the sub-scanning direction between the detecting point of the first detecting unit and the detecting point of the second detecting unit can be accurately specified.

Accordingly, the distance obtained by adding the second correction value to the first correction value is a distance between the detecting point of the first detecting unit and the uppermost nozzle of the nozzle array of the recording head in the sub-scanning direction. That is to say, the rear edge of the recording medium reaches the uppermost nozzle of the nozzle array of the recording head in the sub-scanning direction at the time when the recording medium is conveyed by the amount of conveyance corresponding to the distance obtained by adding the second correction value to the first correction value after the rear end of the recording medium in being recorded is detected by the first detecting unit. Therefore, provided that the position of the rear edge of the recording medium is detected by the first detecting unit, the time point at which the rear edge of the recording medium in being recorded reaches the uppermost nozzle of the nozzle array of the recording head in the sub-scanning direction can be accurately specified based on the amount of conveyance without detecting the rear edge of the recording medium in being recorded by the second recording medium recording unit as before.

Thus, it is not necessary to detect the position of the rear edge of the recording medium in being recorded by the second detecting unit as before, so that a restriction on the position of the carriage that the second detecting unit (PW sensor) has to be disposed upstream than the recording head for forming dots at more than certain distance in the sub-scanning direction.

Thereby the recording apparatus according to the first aspect and the second aspect of the present invention can achieve an advantage that the rear edge of the recording medium in being recorded is more accurately specified to accurately control to mask dot formation in the region behind the position of the rear edge of the recording medium in being recorded.

Additionally, the first correction value and the second correction value is set for each recording apparatus. Therefore, the recording apparatus according to the first aspect and the second aspect of the present invention can achieve an advantage that the rear edge of the recording medium in being recorded is more accurately specified to accurately control to mask dot formation in the region behind the position of the rear edge of the recording medium in being recorded without being influenced by a conveyance error unique to each recording apparatus and a detection error of the end of the recording medium due to the variation within the manufacturing error of such as attaching or assembling the first detecting unit, the second detecting unit, the recording head, the carriage and the recording medium conveying unit and also due to the variation of the accuracy of each component.

Then, a control to mask dot formation in the region behind the position of the rear edge of the recording medium in being recorded can be more accurately performed. Therefore, in the recording apparatus such as an inkjet recording apparatus that ejects ink from the recording head to form dots on the recording surface of the recording medium, the amount of ink discarded out of the recording medium can be more reduced. Accordingly, an wasteful ink consumption which is discarded out of the recording medium can be reduced and the amount of generating so-called ink mist can be more reduced. Therefore, the performance of the reciprocation mechanism of the carriage and the recording medium conveying unit can be prevented from reducing because of ink mist.

A third aspect of the present invention provides the recording apparatus according to the first aspect described above. The recording control unit reversely feeds the recording medium which has been recorded to the upstream side in the sub-scanning direction until the rear edge of the recorded recording medium is detected by the first detecting unit before ejecting the recording medium recorded last at a time when the predetermined total number of recording medium are recorded, and conveys the recorded cording medium to the sub-scanning direction after the carriage is moved to a position at which the rear edge of the recorded recording medium can be detected by the second detecting unit. The recording control unit logically measures the distance in the sub-scanning direction between the detecting point of the first detecting unit and the detecting point of the second detecting unit based on the amount of conveyance of the recorded recording medium for a period between a time point at which the first detecting unit detects the rear edge and a time point at which the second detecting unit detects the rear edge, updates the second correction value and ejects the recorded recording medium.

As described above, at the time when the predetermined total number of recording medium are recorded, the second correction value is obtained using the recorded recording medium before the last recorded recording medium is ejected and the stored second correction value is updated. Thereby the second correction value is updated every time each of the predetermined total number of recording medium is recorded. Therefore, when the conveyance accuracy of the recording medium conveying unit is reduced along with the change over time, a second correction value appropriate for reducing the conveyance accuracy is set, so that a control to mask dot formation in the region behind the position of the rear edge of the recording medium in being recorded can be performed. Accordingly, the control to mask dot formation in the region behind the position of the rear edge of the recording medium in being recorded can be accurately performed adapted to the change over time.

A fourth aspect of the present invention provides the recording apparatus according to the first aspect or the third aspect described above. The recording control unit as described in the first aspect or the third aspect logically measures the distance in the sub-scanning direction between the detecting point of the first detecting unit and the detecting point of the second detecting unit based on the amount of conveying the recording medium for a period between the time point at which the first detecting unit detects the rear edge and the time point at which the second detecting unit detects the rear edge and updates the second correction value, regularly at a predetermined timing.

As described above, the recording control unit updates the second correction value stored therein regularly at a predetermined timing. Thereby the second correction value is updated regularly at a predetermined timing. Therefore, when the conveyance accuracy of the recording medium conveying unit is reduced along with the change over time, a second correction value appropriate for reducing the conveyance accuracy is set, so that a control to mask dot formation in the region behind the position of the rear edge of the recording medium in being recorded can be performed. Additionally, when the threshold value of the first detecting unit or the second detecting unit is changed along with the change over timer an appropriate second correction value is set, so that a control to mask dot formation in the region behind the position of the rear edge of the recording medium in being recorded can be performed. Accordingly, a control to mask dot formation in the region behind the position of the rear edge of the recording medium in being recorded can be accurately performed adapted to the change over time. Here, the "predetermined timing" is the time at which the first recording is performed after a predetermined time lapse and the time at which the first recording is performed after tuning on the recording apparatus.

A fifth aspect of the present invention provides the recording apparatus according to any one of the first aspect-the fourth aspect. The recording control section described in any one of the first aspect-the fourth aspect stores the second correction value unique to each type of recording medium, and performs a control to mask dot formation by the recording head based on the second correction value corresponding to the type of the recording medium.

There are various types of recording medium, such as a plain paper and a photo paper. Accordingly, the frictional resistance on the surface is different for each type of medium, so that the conveyance error generated in conveying the recording medium by the recording medium conveying unit is varied, for example. Therefore, the appropriate second correction value which is logically measured based on the amount of conveyance between the detecting point of the first detecting unit and the detecting point of the second detecting unit is different for each type of the recording medium to be exact. Thus, the second correction value different for each type of the recording medium is set as described above, so that a control to mask dot formation in the region behind the rear edge of the recording medium in being recorded can be appropriately performed dependent on the type of the recording medium. Therefore, a control to mask dot formation in the region behind the rear edge of the recording medium in being recorded can be further accurately performed.

A sixth asset of the present invention provides the recording apparatus according to the above-described aspects 1-5. The recording apparatus further includes a platen that slidably contacts and supports the recording medium conveyed by the recording medium conveying unit and sets a distance between the recording surface of the recording medium and the head surface of the recording bead to a predetermined distance. The second detecting unit includes an optical sensor being capable of detecting the end of the recording medium on the platen based on the difference between an optical reflectance of the surface of the platen in slidably contact with the recording medium and an optical reflectance of the recording surface of the recording medium.

As described above, the optical sensor being capable of detecting the end of the recording medium on the platen out of contact therewith based on the difference between an optical reflectance of the surface of the platen which is in slidably contact with the recording medium and an optical reflectance of the recording surface of the recording medium. Therefore, the second detecting unit can detect the end of the recording medium out of contact therewith.

A seventh aspect of the present invention provides a computer readable medium storing thereon a recording control program. In a recording apparatus including: a carriage having a recording head including a nozzle array with a plurality of nozzles thereon and being capable of reciprocably moving over a recording medium to a main-scanning direction; a recording medium conveying unit that conveys the recording medium to a sub-scanning direction intersecting the main-scanning direction; a first detecting unit disposed upstream than the recording head in the sub-scanning direction that detects at least a rear edge of the recording medium of sub-scanning direction; and a second detecting unit placed on the carriage that detects at least the rear edge of the recording medium downstream than the first detecting unit in the sub-scanning direction, the computer readable medium storing thereon a recording control program that causes the nozzles of the recording head to eject ink onto a recording surface on the recording medium based on recording data as the carriage is reciprocated to the main-scanning direction and that causes the recording medium conveying unit to convey the recording medium to the sub-scanning direction by a predetermined amount of conveyance, the recording control computer readable medium storing thereon the program causes the computer to perform the steps of: storing as a first correction value a distance between a detecting point of the second detecting unit and the uppermost nozzle among the plurality of nozzles of the nozzle array of the recording head in the sub-scanning direction before performing the recording; causing the recording medium conveying unit to convey the recording medium before performing the recording, calculating a distance between the detecting point of the first detecting unit and the detecting point of the second detecting unit based on the amount of conveyance of the recording medium for a period between a time point at which the first detecting unit detects the rear edge and a time point at which the second detecting unit detects the rear edge and storing the same as a second correction value; and starting a control to mask dot formation by the recording head at a time when the recording medium is conveyed by the amount of conveyance corresponding to a distance obtained by adding the second correction value to the first correction value after the rear edge of the recording medium in being recorded is detected by the first detecting unit.

An eighth aspect of the present invention provides a computer readable medium storing thereon a recording control program. In a recording apparatus including: a carriage having a recording head thereon and being capable of reciprocably moving over a recording medium to a main-scanning direction; a recording medium conveying unit being capable of conveying the recording medium to a sub-scanning direction; a first detecting unit disposed upstream than the recording medium conveying unit in the sub-scanning direction and being capable of detecting the front edge and the rear edge of the recording medium in the sub-scanning direction, which is conveyed to the sub-scanning direction by the recording medium conveying unit; and a second detecting unit placed on the carriage and being capable of detecting the end of the recording medium out of contact therewith downstream than the first detecting unit, the computer readable medium storing thereon a recording control program that causes the computer to perform a control to form dots by the recording head on a recording surface of the recording medium based on recording data as the carriage is reciprocated to the main-scanning direction and a control to convey the recording medium by the recording medium conveying unit to the sub-scanning direction by a predetermined mount of conveyance so that a recording on the recording surface of the recording medium is achieved, the recording control computer readable medium storing thereon the program comprising the steps of: previously storing as a first correction value a distance between a detecting point of the second detecting unit, which is physically measured in a manufacturing process of the recording apparatus and the uppermost nozzle of the nozzle array of the recording head in the sub-scanning direction; logically measuring a distance in the sub-scanning between the detecting point of the first detecting unit and the detecting point of the second detecting unit based on the amount of conveyance for a period between a time point at which the first detecting unit detects the rear edge and a time point at which the second detecting unit detects the rear edge and storing the same as a second correction value; and starting a control to mask dot formation by the recording head at a time when the recording medium is conveyed by the amount of conveyance corresponding to a distance obtained by adding the second correction value to the first correction value after the rear edge of the recording medium in being recorded is detected by the first detecting unit.

The computer readable medium storing thereon a recording control program according to the seventh aspect and the eighth aspect can achieve an advantage the same as that described in the first aspect.

A ninth aspect of the present invention provides the computer readable medium storing thereon a recording control program according to the seventh aspect described above. The computer readable medium storing thereon a recording control program according to the seventh aspect further includes the steps of: reversely feeding the recorded recording medium to the upstream side in the sub-scanning direction until the rear edge of the recorded recording medium is detected by the first detecting unit before ejecting the recording medium recorded last at a time when the predetermined total number of recording medium are recorded; moving the carriage to a position at which the rear edge of the recorded recording medium can be detected by the second detecting unit; and conveying the recorded recording medium to the sub-scanning direction, logically measuring a distance between the detecting point of the first detecting unit and the detecting point of the second detecting unit based on the amount of conveyance of the recording medium at the time when the second recording medium conveying unit detects the rear edge after the first detecting unit detects the rear edge and updating the second correction value; and ejecting the recorded recording medium.

The computer readable medium storing thereon a recording control program according to the ninth aspect can provide an advantage the same as that described in the second aspect to any recording apparatus being capable of performing the computer readable medium storing thereon a recording control program.

A tenth aspect of the present invention provide a recording method. In a recording apparatus including: a carriage having a recording head including a nozzle array with a plurality of nozzles thereon and being capable of reciprocably moving over a recording medium to a main-scanning direction; a recording medium conveying unit that conveys the recording medium to a sub-scanning direction intersecting the main-scanning direction; a first detecting unit disposed upstream than the recording head in the sub-scanning direction that detects at least a rear edge of the recording medium of sub-scanning direction; and a second detecting unit placed on the carriage that detects at least the rear edge of the recording medium downstream than the first detecting unit in the sub-scanning direction, wherein the nozzles of the recording head ejects ink onto a recording surface on the recording medium based on recording data as the carriage is reciprocated to the main-scanning direction and the recording medium conveying unit conveys the recording medium to the sub-scanning direction by a predetermined amount of conveyance, the recording method comprising: storing as a first correction value a distance between a detecting point of the second detecting unit and the uppermost nozzle among the plurality of nozzles of the nozzle array of the recording head in the sub-scanning direction before performing the recording; causing the recording medium conveying unit to convey the recording medium before performing the recording, calculating a distance between the detecting point of the first detecting unit and the detecting point of the second detecting unit based on the amount of conveyance of the recording medium for a period between a time point at which the first detecting unit detects the rear edge and a time point at which the second detecting unit detects the rear edge and storing the same as a second correction value; and starting a control to mask dot formation by the recording head at a time when the recording medium is conveyed by the amount of conveyance corresponding to a distance obtained by adding the second correction value to the first correction value after the rear edge of the recording medium in being recorded is detected by the first detecting unit.

BRIEF DESCRIPTION OF DRAWINGS

FIG. 6-1 is a flowchart showing an update procedure of a second correction value; and FIG. 6-2 is a flowchart showing an update procedure of a second correction value.

DESCRIPTION OF EXEMPLARY EMBODIMENTS

Hereinafter, the present invention will now be described through referred embodiments with reference to the drawings.

Firstly, a schematic configuration of the inkjet recording apparatus as an example of recording apparatus according to the present embodiment will be described.

Figure 1:
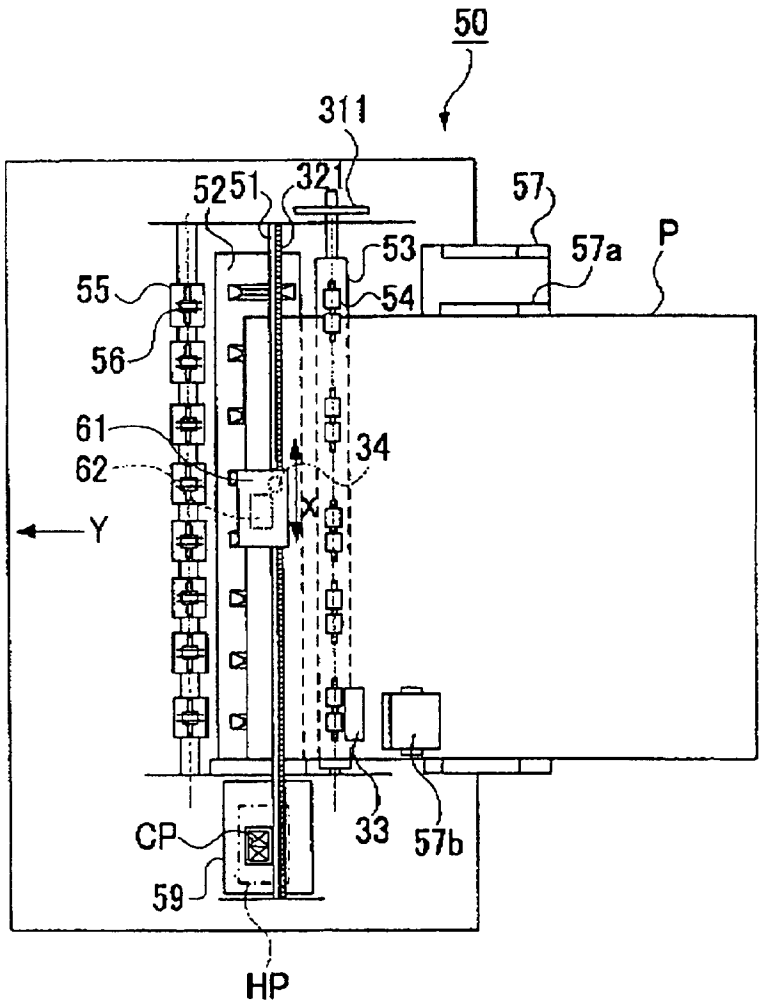
FIG. 1 is a plane view schematically showing a inkjet recording apparatus according to an embodiment.
Figure 2:
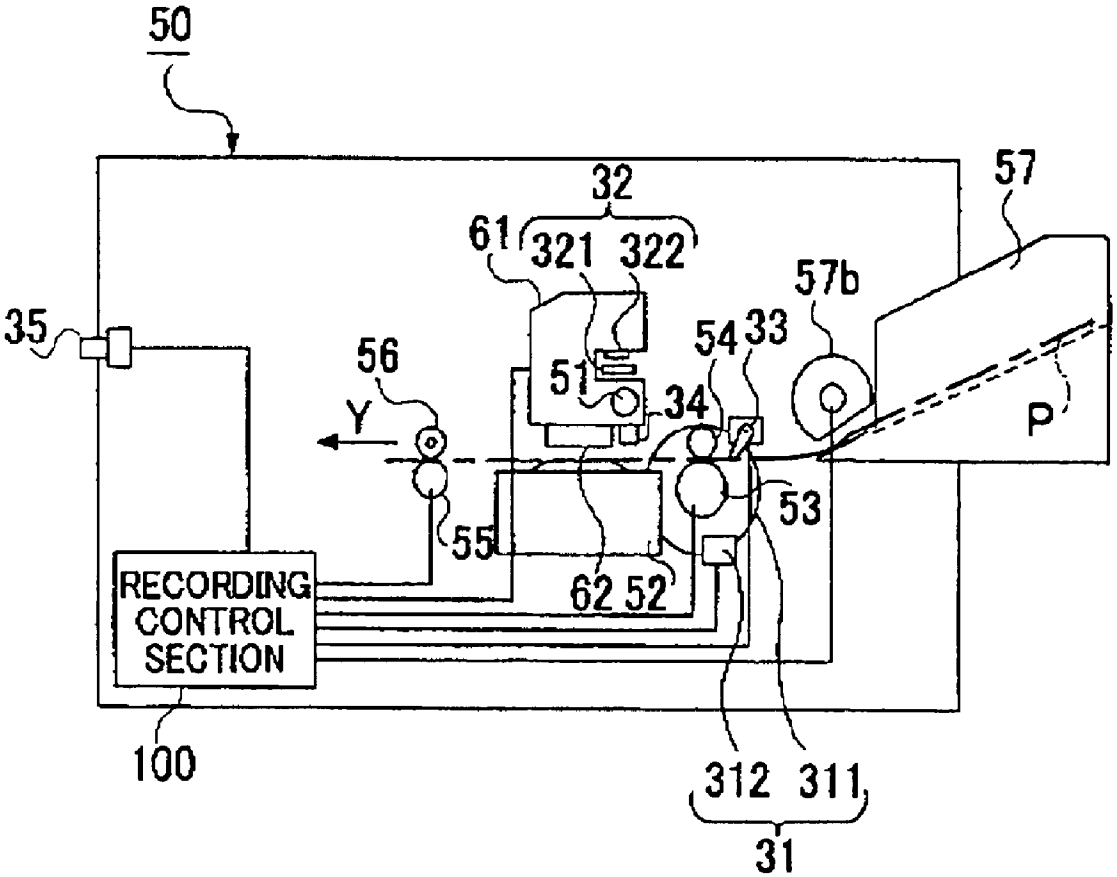
FIG. 2 is a side view schematically shoving a inkjet recording apparatus according to an embodiment.
Figure 3:
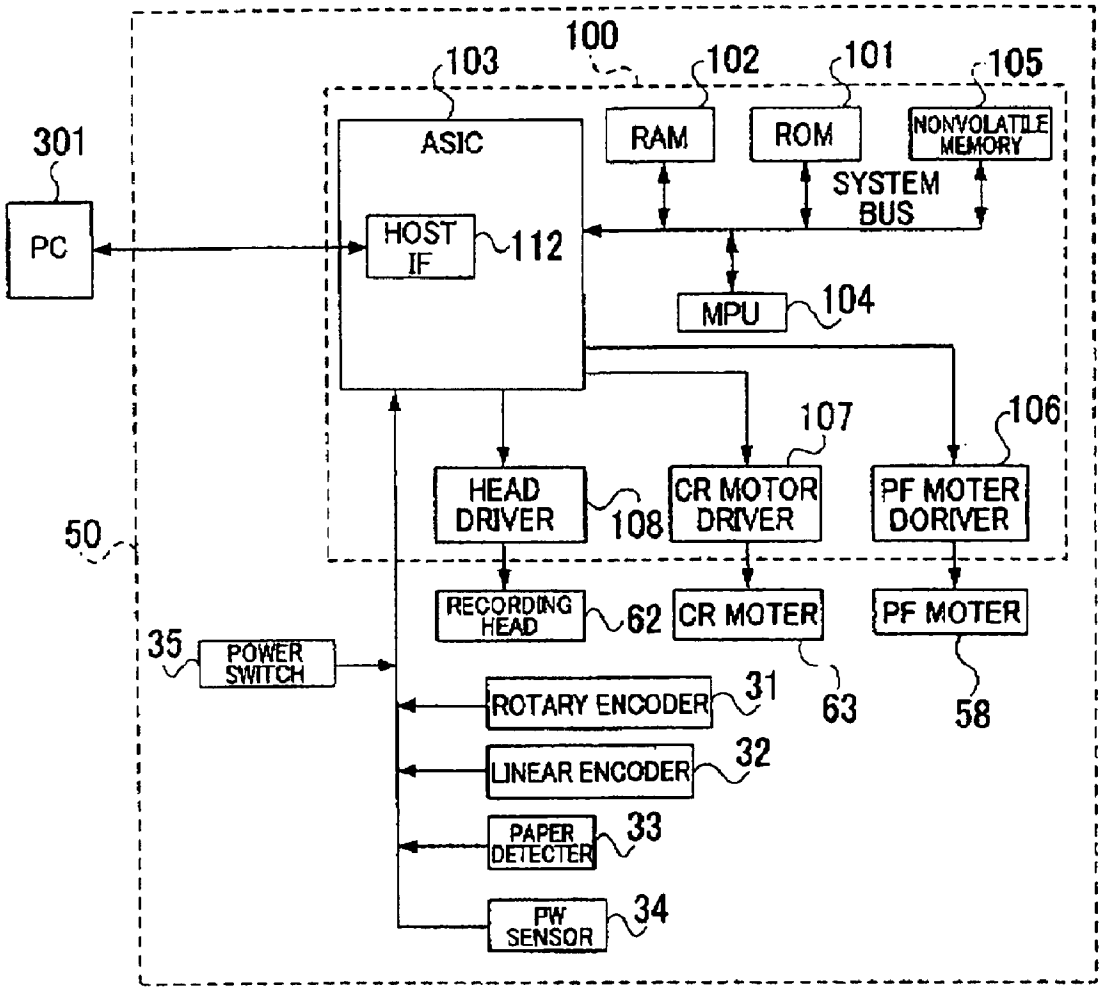
FIG. 3 is block diagram schematically showing a inkjet recording apparatus according to an embodiment.

FIG. 1 is a plane view of the substantial part of the inkjet recording apparatus according to the present embodiment FIG. 2 is a side view thereof. FIG. 3 is a block diagram schematically showing the inkjet recording apparatus according to the present embodiment.

An inkjet according apparatus 50 includes a carriage 61 having a recording head 62 thereon, a paper detector 33 being an example of first detecting unit, a PW sensor 34 being an example of second detecting unit and a recording control section 100 that performs a recording onto the recording medium. For example, the recording medium may be a recording paper P. The carriage 61 of the inkjet recording apparatus 50 has the recording head 62 and the PW sensor 34 thereon. The carriage 61 is pivotally supported by a carriage shaft 51 and reciprocates to a main-scanning direction X by a rotational driving force of a CR motor 63 shown in FIG. 3, which is transferred by a belt transfer mechanism with an endless belt. The carriage 61 reciprocates along the carriage shaft 51 to scan on the recording paper P the recording head 62 for ejecting ink onto the recording paper P in the main-scanning direction X. A platen 52 is disposed on the position opposed to the head surface of the recording head 62. The platen 52 sets the distance between the recording surface of the recording paper P and the head surface of the recording head 62 to a predetermined distance as slidably contacting and supporting the recording paper P conveyed by "a recording medium conveying unit" described later.

A capping device 59 is disposed on the outside of one side of the region in which the carriage 61 is reciprocated to the main-scanning direction X. In a stand-by state where any recording is not performed, the carriage 61 is moved onto the capping device 59 and stopped thereon, so that the head surface of the recording head is sealed with a cap CP provided in the capping device 59. Such stopping position of the carriage 61 is defined as a home position HP.

Additionally, the inkjet recording apparatus 50 includes a conveying drive roller 53, a conveying compliance roller 54 and a PF motor 58 shown in FIG. 3. Those of the conveying drive roller 53, the conveying compliance roller 54 and the PF motor 58 are examples of "recording medium conveying unit". A rotational drive force of the PF motor 58 is transferred by the gear to rotate the conveying drive roller 53, so that the recording paper P is conveyed to a sub-scanning direction Y. There are a plurality of conveying compliance rollers 54, each of which is biased to the conveying drive roller 53. When the recording paper P is conveyed by rotating the conveying drive roller 53, the conveying compliance rollers 54 are rotated in contact with the recording medium P according to the conveyance of the recording medium P. A film having a high frictional resistance is applied to the outer surface of the conveying drive roller 53. The recording paper P pushed on the outer surface of the conveying drive roller 35 by the conveying compliance rollers 54 is tightly attached to the outer surface of the conveying drive roller 53 with the frictional resistance and transferred to the sub-scanning direction by the rotation of the conveying drive roller 53.

A paper feeding tray 57 being capable of stacking a number of recording papers P as "recording medium stacking unit" is disposed at the upstream side of the conveying drive roller 53 in the sub-scanning direction Y. The paper feeding tray 57 feeds the recording paper P such as a plain paper and a photo paper. An ASF (Auto Sheet Feeder) for automatically feeding the uppermost one of the recording papers P stacked on the paper feeding tray 57 to the "recording medium conveying unit" is provided near the paper feeding tray 57. The ASF is an example of "automatic feeding unit", which is an automatic feeding mechanism having a paper feeding roller 57 provided on the paper feeding tray 57 and a separation pad (not shown in the figure). The paper feeding roller 57*b* is disposed on one side of the paper feeding tray 57. A recording paper guide 57*a* is slidably provided on the paper feeding tray 57 in the width direction with fitting to the width of the recording paper P.

By the rotational drive force of the paper feeding roller 57*b* which is generated by which the rotational drive force of the PF motor 58 shown in FIG. 3 is transferred by the gear to the paper feeding roller 57*b* and the paper feeding roller 57*b* is rotated and the frictional resistance of the separation pad, the recording paper P on the paper feeding tray 57 is fed. At this time, a plurality of recording papers are not fed at a time but only the uppermost recording paper is surly separated and automatically fed one by one. A paper detector 33 is disposed between the paper feeding roller 57*b* and the conveying drive roller 53.

The inkjet recording apparatus 50 further includes a paper ejecting drive roller 55 and a paper ejecting compliance roller 56 as means for ejecting the recording paper P which has been recorded. Those of the paper ejecting drive roller 55 and the paper ejecting compliance roller 56, and also the conveying drive roller 53 are examples of "recording medium conveying unit". The paper ejecting drive roller 55 is rotated by transferring a rotational drive force of the PF motor 58 shown in FIG. 3 by the gear, and then, the recording paper P which has been recorded is ejected to the sub-scanning direction Y. The paper ejecting compliance roller 56 has a plurality of teeth on the circumference thereof, which is a toothed roller each of which tip is sharply pointed so as to be in point-contact with the recording surface of the recording paper P. Each of the plurality of paper ejecting compliance rollers 56 is biased to the paper ejecting drive roller 55. Then, when the recording paper P is ejected by rotating the paper ejecting drive roller 55, the paper ejecting compliance rollers 56 is in contact with the recording paper P and rotated according to that the recording paper P is ejected.

Each operation of the PF motor 58 (shown in FIG. 3) for driving the paper feeding roller 57*b*, the conveying drive roller 53 and the paper ejecting drive roller 55, and a CR motor 63 (shown in FIG. 3) for driving the carriage to the main-scanning direction X is controlled by the recording control section 100 described later. The operation of the recording head 62 is also controlled by the recording control section 100 to eject ink onto the surface of the recording paper P. The recording control section 100 performs a control to record on the recording paper by alternately repeating an operation that the recording head 62 ejects ink onto the recoding medium P while the carriage 61 is reciprocated to the main-scanning direction so that dots are formed and an operation that the recording medium P is conveyed to the sub-scanning direction by a predetermined amount of conveyance.

Next, the recording control section 100 as "recording control unit" will be described with reference to FIG. 1-FIG. 3.

The recording control section 100 includes a ROM 101, a RAM 102 and an ASIC (application-specific integrated circuit) 103, a MPU 104, a nonvolatile memory 105 as a nonvolatile recording medium, a PF motor driver 106, a CR motor driver 107 and a head driver 108. The output signal of each of the rotary encoder 31 as means for detecting the amount of rotation of the conveying drive roller 53 through the ASIC 103, a linear encoder 32 as means for detecting the amount of movement of carriage, the paper feeding detector 33 for detecting the rear edge and the front edge of the conveyed recording paper P, the PW sensor 34 for detecting the end of the recording paper P in the main-scanning direction X and the power switch 35 for tuning ON/OFF of the power of the inkjet recording apparatus 50.

The rotary encoder 31 includes a rotary scale 311 that rotates in conjunction with a rotation of the conveying drive roller 53 and a rotary scale sensor 312 that detects slits formed along the circumference of the rotary scale 311 at even intervals shown in FIG. 2. The output signal of the rotary scale sensor 312 which is changed according to the rotation of the conveying drive roller 53 is outputted to a MPU 104 through the ASIC 103.

The linear encoder 32 is an example of "the carriage movement detecting unit" for outputting a detecting signal being capable of specifying a moving direction and the amount of movement of the carriage 61. The linear encoder 32 includes a linear scale 321 which is disposed near the carriage 61 approximately in parallel with the main-scanning direction X and a linear scale sensor 322 which is placed on the carriage 61, for detecting slits formed on the linear scale 321 at even intervals shown in FIG. 2. The output signal of the linear scale sensor 322, whose pulse period dependent on the amount of movement of the carriage 61 in the main-scanning direction X is changed according to the movement speed is outputted to the MPU 104 through the ASIC 103.

The paper detector 33 is an example of "the first detecting unit". The paper detector 33 with self-recovery ability for a standing position includes a lever pivotally supported with projecting into the conveyance path of the recording paper P so as to rotate only in the direction to which the recording paper P is conveyed (sub-scanning direction Y). The lever is rotated because the tip of the lever is pushed by the recording paper P, and thereby the recording paper P is detected shown in FIG. 2. The paper detector 33 detects the start position of the recording paper P fed by the paper feeding roller 57*b* and the end position of the recording paper P in being conveyed, and the detected signal is outputted to the MPU 104 through the ASIC 103.

The PW sensor 34 is an example of "the second detecting unit". The PW sensor 34 is a portion facing the recording surface of the recording paper P of the carriage 61, which detects the end of the recording paper P on the platen 52 out of contact therewith based on the difference between the optical reflectance of the surface being in slidably contact with the recording paper of the platen 52 and the optical reflectance of the recording surface of the recording paper P, and then, the detecting signal is outputted to the MPU 104 through the ASIC 103. The PW sensor 34 is disposed upstream than the recording head 62 in the conveying direction (sub-scanning direction Y). When the carriage 61 is reciprocated to the sub-scanning direction X, the PW sensor 34 can detect the recording paper P at the position upstream than a recording region of the recording head 62 in the conveying direction, i.e. sub-scanning direction. The PW sensor 34 according to the present embodiment has a light emitting section including LEDs and a light receiving section including photodiodes. Here, the light emitted from the light emitting section impinges on the recording paper P to be detected or the platen 52, and the reflected light is received by the light receiving section. The PW sensor 34 further includes a reflective photo interrupter of which output voltage is changed dependent on the amount of light received.

The ROM 101, the RAM 102, the ASIC 103, the MPU 104 and the nonvolatile memory 105 are connected to a system bus of the recording control section 100. The MPU 104 performs an arithmetic processing for controlling to record by the inkjet recording apparatus 50 and the other necessary arithmetic processing. The ROM 101 stores a recording control program, e.g. a firmware required for controlling the inkjet recording apparatus 50 by the MPU 104. The nonvolatile memory 105 stores various data required for processing the recording control program. The RAM 102 is used as a work area of the MPU 104 and a memory area in which recording data is stored.

The ASIC 103 has a control circuit for controlling the speed of the PF motor 58 and a CR motor 63 as DC motors and also controlling the operation of the recording head 62. The ASIC 103 performs various arithmetic processing for controlling the speed of the PF motor 58 and the CR motor 63 based on the control signal transmitted from the MPU 104, the output signal of the rotary encoder 31 and the output signal of the linear encoder 32 and transmits a motor control signal based on the result to a PF motor driver 106 and a CR motor driver 107. The ASIC 103 generates a control signal of the recording head 62 by an arithmetic processing and transmits the same to the head driver 108 to control the operation of the recording head 62. The ASIC 103 has a host IF 112 as "a communication means" that can communicate with a personal computer as "an information processor"

Next a process to specify the rear edge of the recording paper p in being recorded in the conveying direction, i.e. the rear edge in the sub-scanning direction in order to perform "a control to mask dot formation in the region behind the position of the rear edge of the recording medium being recorded (hereinafter simply referred to as "mask control" will be described.

Figure 4:
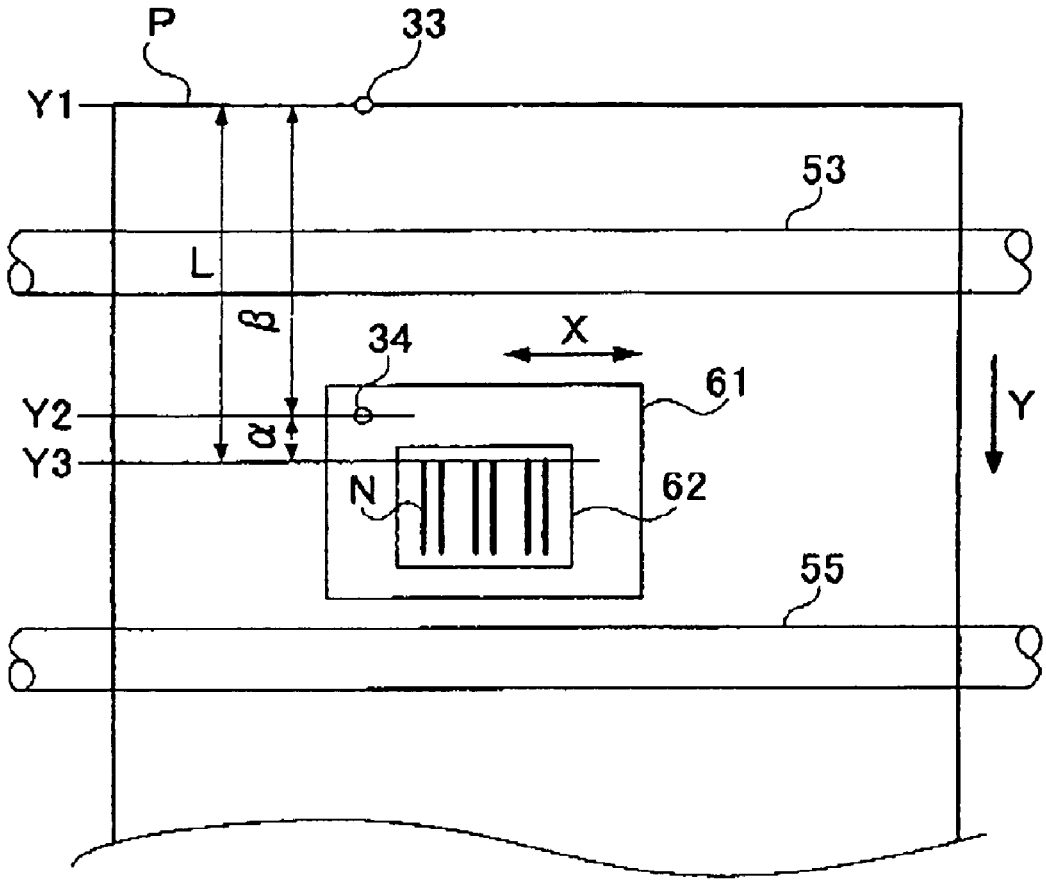
FIG. 4 is a plane view schematically showing the substantial part of the inkjet recording apparatus.

FIG. 4 is a plane view schematically showing the substantial part of the inkjet recording apparatus 50 according to the present embodiment.

The recording paper P in being recorded is conveyed to the sub-scanning direction Y by rotating the conveying drive roller 53 and the paper ejecting drive roller 55. The paper detector 33 can detect the font edge and the rear edge of the recording paper P in the sub-scanning direction Y, which is conveyed to the sub-scanning direction Y by the conveying drive roller 53 and the paper ejecting drive roller 55. The paper detector 33 is disposed upstream than the conveying drive roller 53 and the paper ejecting drive roller 55 in the sub-scanning direction Y, that is, the paper detector 33 is disposed upstream than the recording head 62 in the sub-scanning direction Y. Additionally, the PW sensor 34 can detect the end of the recording paper P out of contact therewith downstream than the paper detector 33 in the sub-scanning direction Y. The PW sensor 34 is disposed near the recording head 62 of the carriage 61 and is capable of scanning the recording surface of the recording paper P by the PW sensor 34 by reciprocating the carriage 61 to the main-scanning direction X.

The recording control section 100 previously stores the distance between a detecting point Y2 of the PW sensor 34, which is physically measured in a manufacturing process of the inkjet recording apparatus 50 and an uppermost nozzle position Y3 of the nozzle array N of the recording head 62 in the sub-scanning direction in the nonvolatile memory 105 shown in FIG. 3 as a first correction value α. Specifically, the first correction value α is actually measured on the carriage 61 by using a measurer before mounting the carriage 61 on the inkjet recording apparatus 50, for α example. That is to say, the first correction value α is the correction value unique to each inkjet recording apparatus 50 because the measure is physically performed for each inkjet recording apparatus 50 in the manufacturing process of the inkjet recording apparatus 50.

Here, the detecting point Y2 of the PW sensor 34 is disposed upstream than the uppermost nozzle position Y3 of the nozzle array N of the recording head 62 in the sub-scanning direction in the present embodiment. However, characteristically, the placement of the PW sensor 34 according to the present embodiment is not limited to the above-described placement. For example, the detecting point Y2 of the PW sensor 34 may be disposed downstream than the uppermost nozzle position Y3 of the nozzle array N of the recording head 62 in the sub-scanning direction. Here, the first correction value α is a positive correction value provided that the detecting point Y2 of the PW sensor 34 is disposed upstream than the uppermost nozzle position Y3 of the nozzle array N of the recording head 62. Meanwhile, the first correction value α is a negative correction value provided that the detecting point Y2 of the PW sensor 34 is disposed downstream than the uppermost nozzle position Y3 of the nozzle array N of the recording head 62.

The recording control section 100 logically measures the distance in the sub-scanning direction between the detecting point Y1 of the paper detector 33 and the detecting point Y2 of the PW sensor 34 based on the amount of conveyance for a period between a time point at which the rear edge of the recording paper P is detected at the detecting point Y1 of the paper detector 33 and a time point at which the rear edge of the recording paper P is detected at the detecting point Y2 of the PW sensor 34 and previously stores the same in the nonvolatile memory 105 shown in FIG. 3 as a second correction value β. Specifically, the second correction value β is calculated based on the amount of rotating the conveying drive roller 53 for a period between the time point at which the rear edge of the recording paper P is detected at the detecting point Y1 of the paper detector 33 and the time point at which the rear edge of the recording paper P is detected at the detecting point Y2 of the PW sensor 34 and the length of the circumference of the conveying drive roller 53, for example. The amount of rotating the conveying drive roller 53 is calculated based on the output signals (the number of output pulses) of the rotary encoder 31 shown in FIG. 1-FIG. 3 and the resolution of the rotary encoder 31.

Figure 5:
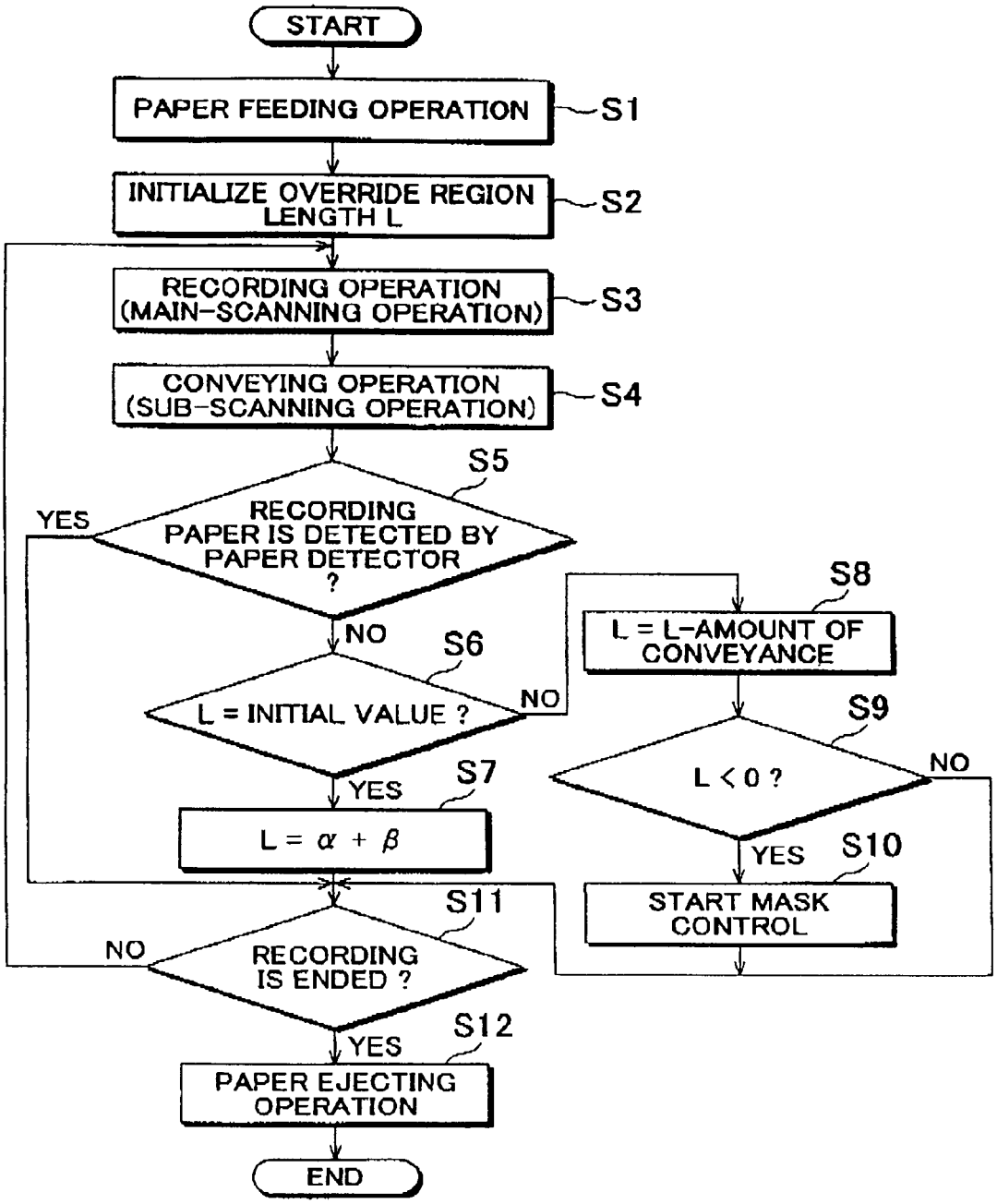
FIG. 5 is a flowchart showing a recording control procedure and a mask control procedure.

FIG. 5 is a flowchart showing a recording control procedure and a mask control procedure on the recording paper P in the recording control section 100. Hereinafter, it will be described with reference to the flowchart and also FIG. 4.

After the recording paper P is fed from the paper feeding tray 57 and conveyed the same to the position at which a recording is started (step S1), an initial value is set to an override region length L and initialized (step S2). The override region length L is a value used for the mask control described above, which means the length of the recording paper P between the rear edge of the recording paper P in being recorded, i.e. the rear edge in the sub-scanning direction Y and the uppermost nozzle position of the nozzle array N of the recording head 62 in the sub-scanning direction. Here, the initial value is a predetermined value other than zero. A recording operation to form dots by which the recording head 62 ejects ink onto the fed recording paper P as carriage 61 is reciprocated to the main-scanning direction X, i.e. a main-scanning operation is performed (step S3). Then, a conveying operation to convey the recording paper P to the sub-scanning direction Y by a predetermined amount of conveyance, i.e. a sub-scanning operation is performed (step S4).

Next, it is judged whether the paper detector 33 detects the recording paper P after the recording paper P is conveyed (step S5). When the paper detector 33 detects the recording paper P (step S5: Yes), it is judged whether a recording on the recording paper is completed (step S11). When the recording on the recording paper is completed (step S11: Yes), the recording paper P is ejected (step S12) and the process is ended. Alternatively, when the recording on the recording paper P is not completed (step S11: No), turn back to the step S3 and the recording operation (the step S39) and the conveying operation (the step S4) on the recording paper P are performed.

Meanwhile, when the paper detector 33 does not detect the recording paper P (step S5: No), it is judged whether the override region length L is still the initial value (step S6). When override region length L is s11 the initial value (step S6: Yers), it is judged that the rear edge of the recording paper P passes through the detecting point Y1 in the last conveying operation (step S4), and a value obtained by adding the second correction value β to the first correction value α is set to the override region length L (step S7). Next, it is judged whether the recording on the recording paper P is completed (step S11: Yes), the recording paper P is ejected (step S12) and the process is ended. Alternatively, when the recording on the recording paper P is not completed (step S11: No), turn back to the step S3 and the recording operation (the step S3) and the conveying operation (the step S4) on the recording paper P are performed.

Since the value obtained by adding the second correction value β to the first correction value α is set to the override region length L (the step S6; No), the amount of conveyance at the conveying operation is subtracted from the override region length L and the override region length L is updated every time the recording operation and the conveying operation on the recording paper P are performed (step S8) and then, it is judged whether the override length is less than zero (Step S9). When the override region length L is not less than zero (step S9: No), it is judged whether the recording on the recording paper is completed (step S11). Alternatively, the recording on the recording paper P is completed (step S11: Yes), the recording paper P is ejected (step S112) and the process is ended. Alternatively, when the recording on the recording paper P is not completed (step S11: No), turn back to the step S3 and the recording operation (the step S3) and the conveying operation (the step S4) on the recording paper P are performed.

Then, at the time when the override region length L is less than zero (the step S9: zero), it is judged that the rear edge of the recording paper P reaches the uppermost nozzle position Y3 of the nozzle array N of the recording head 62 in the sub-scanning direction and a mask control is started (step S10). It is judged whether the recording on the recording paper P is completed (step S11). When the recording on the recording paper P is not completed (step 11: No), turn back to the step S3 and the recording operation (the step S3) and the conveying operation (the step S4) on the recording paper P are performed. Then, at the time when the recording on the recording paper P is completed, the recording paper P is ejected (step S12) and the process is ended.

As evidenced by FIG. 4, the override region length L obtained by adding the second correction value β to the first correction value α is the distance between the detecting point Y1 of the paper detector 33 and the uppermost nozzle position Y3 of the nozzle array N of the recording head 62 in the sub-scanning direction. Accordingly, as the steps shown in the flowchart of FIG. 5, it can be judged that the rear edge of the recording paper P reaches the uppermost nozzle position Y3 of the nozzle array N of the recording head 62 in the sub-scanning direction at the time when the recording paper P is conveyed by the amount of conveyance (override region length) corresponding to the distance obtained by adding the second correction value β to the first correction value α, i.e. at the time point when the override region length is L<0) after the rear edge of the recording paper P in being recorded is detected at the detecting point Y1 of the paper detector 33.

Then, if a mask control is started at the above-described timing, it is not necessary to detect the rear edge of the recording paper P in being recorded by the sensor as before. Additionally, a mask control can be started under the condition that the time point at which the rear edge of the recording paper P in being recorded reaches the uppermost nozzle position Y3 of the nozzle array N of the recording head 62 can be accurately specified as before. Additionally, it is not necessary to detect the position of the rear edge of the recording paper P in being recorded by the PW sensor 34 as before, therefore, a restriction on the placement of the PW sensor 61 on the carriage 61 that the PW sensor should be disposed upstream than the recording head 62 in the sub-scanning direction at more than a certain interval.

Thus, the inkjet recording apparatus 50 according to the present embodiment can more accurately specify the rear edge of the recording paper P in being recorded and more accurately perform a mask control on the rear edge of the recording paper P in being recorded.

Additionally, the first correction value α and the second correction value β are set to each inkjet recording apparatus 50, respectively. Therefore, a mask control on the rear edge of the recording paper P in being recorded can be accurately performed without being influenced by the conveyance error unique to each inkjet recording apparatus 50 and the detection error of the end of the recording paper P due to the variation within the manufacturing error of the mounting location and the assembling of the paper detector 33, the PW sensor 34, the recording head 62, the carriage 61 and the conveying drive roller 53 and the variation of the accuracy for each component.

Then, a mask control on the rear edge of the recording paper P in being recorded can be more accurately performed. Therefore, the amount of ink discarded out of the recording medium can be more reduced particularly when a flameless recording that performs a recording on the recording paper P such that there is no margin in all sides. Accordingly, an wasteful ink consumption which is discarded out of the recording medium can be reduced and the amount of generating so-called ink mist can be more reduced. Therefore, the performance of the reciprocation mechanism of the carriage 61 and the rotational drive mechanism of the conveying drive roller 53 can be prevented from being reduced because of ink mist.

Figures 1, 6:
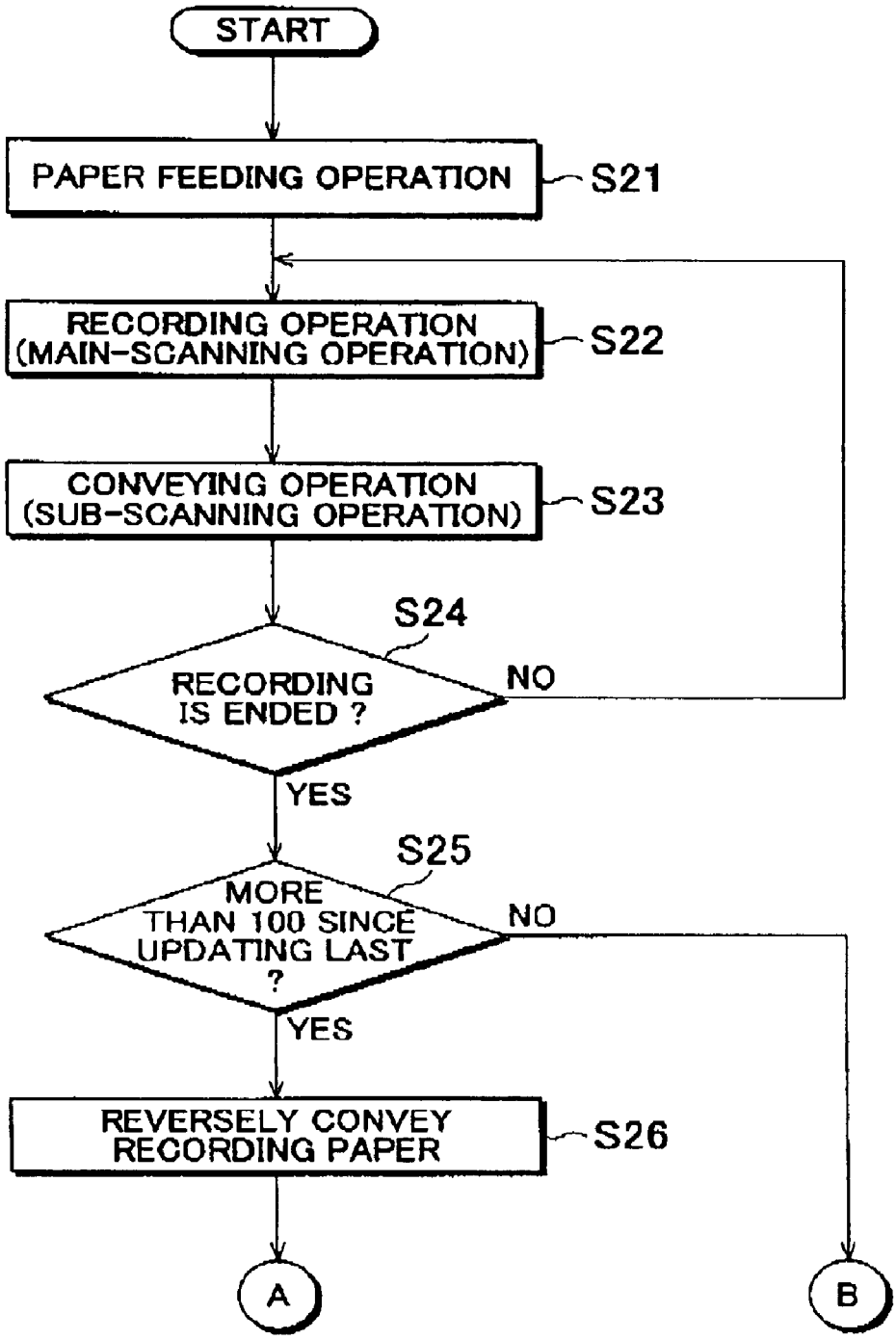
Figures 2, 6:
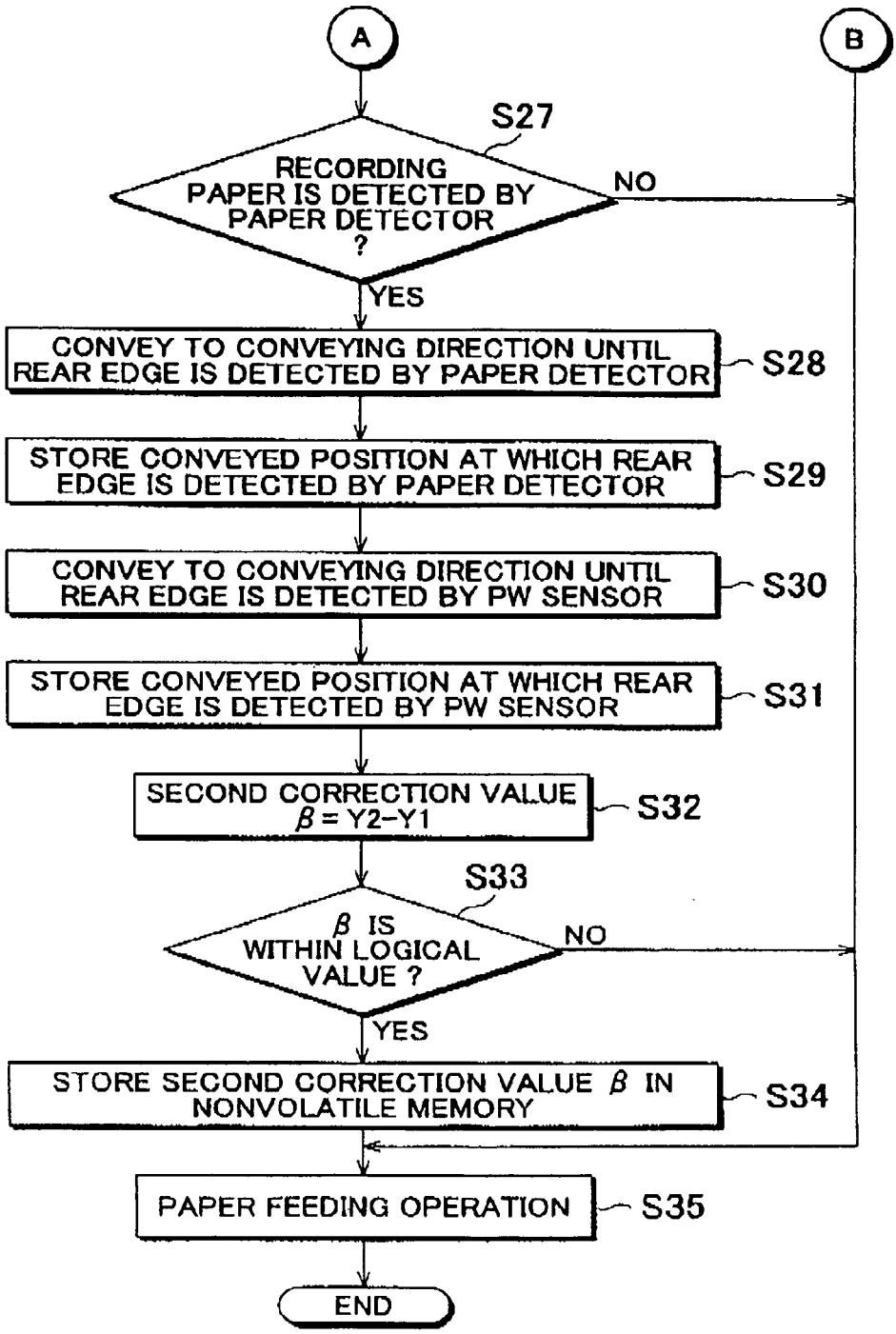

FIG. 6 is a flowchart showing a recording control procedure on the recording paper P and a procedure of updating the second correction value β. Hereinafter, it will be described with reference to the flowchart and also FIG. 4.

After feeding the recording paper P from the paper feeding tray 57 and conveying the recording paper P to the recording start position (step S21), a recording on the recording paper P is performed by alternately performing an operation to form dots by ejecting ink on the recording paper P from the recording head 62 while the carriage 61 is reciprocated to the main-scanning direction X (step 22: main-scanning operation) and an operation to convey the recording paper P to the sub-scan g direction Y by a predetermined amount of conveyance (step S23: sub-scanning operation). Then, at the time when the recording on the recording paper P is completed (step S24: Yes), it is judged whether the predetermined total number of recording papers P on which recording is performed is more than 100 sheets as a predetermined total number since the second correction value β is updated at the previous time (step S25).

When the predetermined total number of recording papers P on which recording is performed is not more than 100 sheets since the second correction value β is updated at the previous time (step S25: No), the recording paper P is ejected (step S35) and the procedure is ended. Meanwhile, when the predetermined total number of recording papers P on which recording is performed is more than 100 sheets since the second correction value β is updated at the previous time (step S25: Yes), the recording paper P is reversely fed by a certain amount of conveyance, i.e. conveyed to the direction opposed to the sub-scanning direction Y. The certain amount of conveyance should be the amount enough to reversely feed the recording paper P to the detecting point Y1 of the paper detector at which the recording paper P is detected.

Next, it is judged whether the recording paper P is reversely fed to the position at which the recording paper is detected by the paper detector 33 (step S27). When the recording paper P is not detected by the paper detector 33, it is considered that there is any problem so that the recording paper P is ejected (step S35), and the procedure is ended. Meanwhile, when the recording paper P is detected by the paper detector 33 (step S27: Yes), it is judged that the recording paper is reversely fed normally and shift to steps of updating the second correction value β (steps S28-S34) described later.

Firstly, the recording paper P is conveyed to the conveyance direction, i.e. sub-scanning direction Y until the paper detector 33 detects the rear edge of the recording paper P (step S28) and the position to which the recording paper P is conveyed at the time when the rear edge of the recording paper P is detected at the detecting point Y1 is stored as Y1 (step S29). Next, after the carriage 61 is moved to a position at which the rear edge of the recording paper P can be detected by the PW sensor 34, the recording paper P is conveyed to the conveyance direction, i.e. sub-scanning direction until the rear edge of the recording paper P is detected by the PW sensor (step S30), and the position to which the recording paper is conveyed at the time when the rear edge of the recording paper P is detected at the detecting point Y2 of the PW sensor 34 is stored as Y2 (step S31).

Then, the second correction value β is calculated by subtracting Y1 from Y2 (step S32), and it is judged whether the calculated second correction value β is within a logical value. The logical value is within numerical values, which is a design distance between the detecting point Y1 of the paper detector 33 and the detecting point Y2 of the PW sensor 34 with a mechanical tolerance.

When the calculated second correction value β is not within the logical value (step S33: No), it is judged that the calculated second correction value β is not appropriate value and significantly out of the logical value because the recording paper P is not normally conveyed due to any problem. Then, the recording paper P is ejected without updating the second correction value β stored in the nonvolatile memory 105 (step S35) and the procedure is ended. Meanwhile, when the calculated second correction value βis within the logical value (step S33: Yes), the second correction value β stored in the nonvolatile memory 105 is replaced with the calculated new second correction value β and updated (step S34). Then, the recording paper P is ejected (step S35) and the procedure is ended.

As described above, at the time when the recording on the predetermined total number of recording papers P is completed, the second correction value β is acquired by using the recording paper P recorded last before the recording paper P recorded last is ejected and the stored second correction value βis updated. Thereby the second correction value β is updated for each of the predetermined total number of recordings. Therefore, when the accuracy of the conveyance by the conveying drive roller 53 is reduced along with the change over time, an appropriate second correction value β is set dependent on the reduction of the accuracy of the conveyance is set, so that a mask control on the rear edge of the recording paper P in being recorded can be performed. Additionally, when the threshold value of the paper detector 33 or the PW sensor 34 is changed along with the change over time, an appropriate second correction value β is set dependent on the reduction of the accuracy of the conveyance is set, so that a control to mask dot formation in the region behind the position of the recording medium can be performed. Here, "the predetermined total number" is set to 100 sheets in the present embodiment, however, the number is not limited to that. The number may be set according to the configuration of the recording apparatus, of course.

Additionally, the second correction value may be regularly updated by the above-described steps at a predetermined timing other than the timing at which the predetermined total number of recordings are completed. Here, "the predetermined timing" may be set with any condition. For example, the predetermine timing is set as a time at which the first recording is performed after lapsing a certain time, or a time at which the first recording is performed after the inkjet recording apparatus 50 is turned on. Therefore, even if a recording is not often performed, the second correction value β can be updated at an appropriate timing.

Further, if the type of the recording paper P is varied, the conveyance error generated when the conveying drive roller 53 conveys the recording paper P is varied because the frictional resistance of the surface is different for each type. Therefore, it is more preferred that the second correction value β unique to each type of the recording papers P is stored, and then, a mask control on the rear edge of the recording medium P in being recorded is performed based on the second correction value β corresponding to the type of the recording paper P when a recording on the recording paper is performed. Thereby the mask control on the rear edge of the recording paper P in being recorded can be more accurately performed.

While the present invention have been described with the embodiment, the technical scope of the invention not limited to the above described embodiment. The present invention may applicable to a printer of the inkjet recording apparatus and a recording apparatus such as a copy machine and a facsimile. It is apparent to persons skilled in the art that various alternations and improvements can be added to the above-described embodiment. It is apparent from the scope of the claims that the embodiment added such alternation or improvements can be included in the technical scope of the invention.

What is claimed is:

1. A recording apparatus comprising:

a carriage having a recording head including a nozzle array with a plurality of nozzles thereon and being capable of reciprocably moving over a recording medium to a main-scanning direction;

a recording medium conveying unit that conveys the recording medium to a sub-scanning direction intersecting the main-scanning direction;

a first detecting unit disposed upstream than the recording head in the sub-scanning direction that detects at least a rear edge of the recording medium of the sub-scanning direction;

a second detecting unit placed on the carriage that detects at least the rear edge of the recording medium downstream than the first detecting unit in the sub-scanning direction; and a recording control unit that causes the plurality of nozzles of the recording head to eject ink onto a recording surface on the recording medium based on recording data as the carriage is reciprocated to the main-scanning direction and that causes the recording medium conveying unit to convey the recording medium to the sub-scanning direction by a predetermined amount of conveyance, wherein the recording control unit stores as a first correction value a distance between a detecting point of the second detecting unit and the uppermost nozzle among the plurality of nozzles of the nozzle array of the recording head in the sub-scanning direction before performing the recording, the recording control unit, before performing the recording, causes the recording medium conveying unit to convey the recording medium, calculates a distance between the detecting point of the first detecting unit and the detecting point of the second detecting unit based on the amount of conveyance of the recording medium for a period between a time point at which the first detecting unit detects the rear edge and a time point at which the second detecting unit detects the rear edge and, stores the same as a second correction value, and the recording control unit starts a control to mask dot formation by the recording head at a time when the recording medium is conveyed by the amount of conveyance corresponding to a distance obtained by adding the second correction value to the first correction value after the rear edge of the recording medium being recorded is detected by the first detecting unit.

2. A recording apparatus comprising:

a carriage having a recording head thereon and being capable of reciprocably moving over a recording medium to a main-scanning direction;

a recording medium conveying unit being capable of conveying the recording medium to a sub-scanning direction;

a first detecting unit disposed upstream than the recording medium conveying unit in the sub-scanning direction and being capable of detecting the front edge and the rear edge of the recording medium in the sub-scanning direction, which is conveyed to the sub-scanning direction by the recording medium conveying unit;

a second detecting unit placed on the carriage and being capable of detecting the end of the recording medium out of contact therewith downstream than the first detecting unit; and a recording control unit that performs a control to form dots by the recording head on a recording surface of the recording medium based on recording data as the carriage is reciprocated to the main-scanning direction and a control to convey the recording medium by the recording medium conveying unit to the sub-scanning direction by a predetermined amount of conveyance so that a recording on the recording surface of the recording medium is achieved, wherein the recording control unit previously stores as a first correction value a distance between a detecting point of the second detecting unit, which is physically measured in a manufacturing process of the recording apparatus and the uppermost nozzle of a nozzle array of the recording head in the sub-scanning direction, the recording control unit logically measures a distance in the sub-scanning direction between a detecting point of the first detecting unit and the detecting point of the second detecting unit based on the amount of conveyance for a period between a time point at which the first detecting unit detects the rear edge and a time point at which the second detecting unit detects the rear edge and stores the same as a second correction value, and the recording control unit starts a control to mask dot formation by the recording head at a time when the recording medium is conveyed by the amount of conveyance corresponding to a distance obtained by adding the second correction value to the first correction value after the rear edge of the recording medium being recorded is detected by the first detecting unit.

3. The recording apparatus as set forth in claim 1, wherein the recording control unit reversely feeds the recording medium which has been recorded to the upstream side in the sub-scanning direction until the rear edge of the recorded recording medium is detected by the first detecting unit before ejecting the recording medium recorded last at a time when the predetermined total number of recording medium are recorded, and conveys the recorded recording medium to the sub-scanning direction after the carriage is moved to a position at which the rear edge of the recorded recording medium can be detected by the second detecting unit, and the recording control unit logically measures the distance in the sub-scanning direction between the detecting point of the first detecting unit and the detecting point of the second detecting unit based on the amount of conveyance of the recorded recording medium for a period between a time point at which the first detecting unit detects the rear edge and a time point at which the second detecting unit detects the rear edge, updates the second correction value and ejects the recorded recording medium.

4. The recording apparatus as set forth in claim 1, wherein the recording control unit logically measures the distance in the sub-scanning direction between the detecting point of the first detecting unit and the detecting point of the second detecting unit based on the amount of conveyance for the period between the time point at which the first detecting unit detects the rear edge and a time point at which the second detecting unit detects the rear edge and updates the second correction value, regularly at a predetermined timing.

5. The recording apparatus as set forth in claim 1, wherein the recording control unit stores the second correction value unique to each type of the recording medium and performs a control to mask dot formation by the recording head based on the second correction value corresponding to the type of the recording medium at performing a recording on the recording medium.

6. The recording apparatus as set forth in claim 1 further comprising a platen that slidably contacts and supports the recording medium conveyed by the recording medium conveying unit and sets a distance between the recording surface of the recording medium and the head surface of the recording head to a predetermined distance, the second detecting unit including an optical sensor being capable of detecting the end of the recording medium on the platen based on the difference between an optical reflectance of the surface of the platen in slidable contact with the recording medium and an optical reflectance of the recording surface of the recording medium.

7. In a recording apparatus including: a carriage having a recording head including a nozzle array with a plurality of nozzles thereon and being capable of reciprocably moving over a recording medium to a main-scanning direction; a recording medium conveying unit that conveys the recording medium to a sub-scanning direction intersecting the main-scanning direction; a first detecting unit disposed upstream than the recording head in the sub-scanning direction that detects at least a rear edge of the recording medium of sub-scanning direction; and a second detecting unit placed on the carriage that detects at least the rear edge of the recording medium downstream than the first detecting unit in the sub-scanning direction, a computer readable medium storing thereon a recording control program that causes the nozzles of the recording head to eject ink onto a recording surface on the recording medium based on recording data as the carriage is reciprocated to the main-scanning direction and that causes the recording medium conveying unit to convey the recording medium to the sub-scanning direction by a predetermined amount of conveyance, the recording control program causing a computer to perform the steps of:

storing as a first correction value a distance between a detecting point of the second detecting unit and the uppermost nozzle among the plurality of nozzles of the nozzle array of the recording head in the sub-scanning direction before performing the recording;

causing the recording medium conveying unit to convey the recording medium before performing the recording, calculating a distance between the detecting point of the first detecting unit and the detecting point of the second detecting unit based on the amount of conveyance of the recording medium for a period between a time point at which the first detecting unit detects the rear edge and a time point at which the second detecting unit detects the rear edge and storing the same as a second correction value; and starting a control to mask dot formation by the recording head at a time when the recording medium is conveyed by the amount of conveyance corresponding to a distance obtained by adding the second correction value to the first correction value after the rear edge of the recording medium being recorded is detected by the first detecting unit.

8. In a recording apparatus including: a carriage having a recording head thereon and being capable of reciprocably moving over a recording medium to a main-scanning direction; a recording medium conveying unit being capable of conveying the recording medium to a sub-scanning direction; a first detecting unit disposed upstream than the recording medium conveying unit in the sub-scanning direction and being capable of detecting the front edge and the rear edge of the recording medium in the sub-scanning direction, which is of sub-scanning direction; and a second detecting unit placed on the carriage and being capable of detecting the end of the recording medium out of contact therewith downstream than the first detecting unit, a computer readable medium storing thereon a recording control program that causes a computer to perform a control to form dots by the recording head on a recording surface of the recording medium based on recording data as the carriage is reciprocated to the main-scanning direction and a control to convey the recording medium by the recording medium conveying unit to the sub-scanning direction by a predetermined amount of conveyance so that a recording on the recording surface of the recording medium is achieved, the recording control program comprising the steps of:

previously storing as a first correction value a distance between a detecting point of the second detecting unit, which is physically measured in a manufacturing process of the recording apparatus and the uppermost nozzle of the nozzle array of the recording head in the sub-scanning direction;

logically measuring a distance in the sub-scanning direction between the detecting point of the first detecting unit and the detecting point of the second detecting unit based on the amount of conveyance for a period between a time point at which the first detecting unit detects the rear edge and a time point at which the second detecting unit detects the rear edge and storing the same as a second correction value; and starting a control to mask dot formation by the recording head at a time when the recording medium is conveyed by the amount of conveyance corresponding to a distance obtained by adding the second correction value to the first correction value after the rear edge of the recording medium being recorded is detected by the first detecting unit.

9. The recording control program as set forth in claim 7 further comprising the steps of:

reversely feeding the recorded recording medium to the upstream side in the sub-scanning direction until the rear edge of the recorded recording medium is detected by the first detecting unit before ejecting the recording medium recorded last at a time when the predetermined total number of recording medium are recorded;

moving the carriage to a position at which the rear edge of the recorded recording medium can be detected by the second detecting unit;

conveying the recorded recording medium to the sub-scanning direction, logically measuring a distance between the detecting point of the first detecting unit and the detecting point of the second detecting unit based on the amount of conveyance of the recording medium at the time when the second recording medium conveying unit detects the rear edge after the first detecting unit detects the rear edge and updating the second correction value; and ejecting the recorded recording medium.

10. In a recording apparatus including: a carriage having a recording head including a nozzle array with a plurality of nozzles thereon and being capable of reciprocably moving over a recording medium to a main-scanning direction; a recording medium conveying unit that conveys the recording medium to a sub-scanning direction intersecting the main-scanning direction; a first detecting unit disposed upstream than the recording head in the sub-scanning direction that detects at least a rear edge of the recording medium of sub-scanning direction, and a second detecting unit placed on the carriage that detects at least the rear edge of the recording medium downstream than the first detecting unit in the sub-scanning direction, wherein the nozzles of the recording head eject ink onto a recording surface on the recording medium based on recording data as the carriage is reciprocated to the main-scanning direction and the recording medium conveying unit conveys the recording medium to the sub-scanning direction by a predetermined amount of conveyance, a recording method comprising:

storing as a first correction value a distance between a detecting point of the second detecting unit and the uppermost nozzle among the plurality of nozzles of the nozzle array of the recording head in the sub-scanning direction before performing the recording;

causing the recording medium conveying unit to convey the recording medium before performing the recording, calculating a distance between the detecting point of the first detecting unit and the detecting point of the second detecting unit based on the amount of conveyance of the recording medium for a period between a time point at which the first detecting unit detects the rear edge and a time point at which the second detecting unit detects the rear edge and storing the same as a second correction value; and starting a control to mask dot formation by the recording head at a time when the recording medium is conveyed by the amount of conveyance corresponding to a distance obtained by adding the second correction value to the first correction value after the rear edge of the recording medium being recorded is detected by the first detecting unit.

* * * * *